US008993497B2

(12) United States Patent
Iwamatsu et al.

(10) Patent No.: US 8,993,497 B2
(45) Date of Patent: Mar. 31, 2015

(54) GREASE COMPOSITION AND BEARING

(71) Applicant: NIPPON GREASE Co., Ltd., Osaka-shi, Osaka (JP)

(72) Inventors: Hiroki Iwamatsu, Kobe (JP); Kenji Yuki, Kobe (JP); Masahiro Okumiya, Nagoya (JP)

(73) Assignee: Nippon Grease Co., Ltd., Osaka-shi (JP)

( * ) Notice: Subject to any disclaimer, the term of this patent is extended or adjusted under 35 U.S.C. 154(b) by 109 days.

(21) Appl. No.: 13/684,372

(22) Filed: Nov. 23, 2012

(65) Prior Publication Data

US 2013/0137612 A1 May 30, 2013

(30) Foreign Application Priority Data

Nov. 25, 2011 (JP) ..... 2011-258234

(51) Int. Cl.

| | |
|---|---|
| ***C10M 125/00*** | (2006.01) |
| ***C01G 41/00*** | (2006.01) |
| ***C10M 125/22*** | (2006.01) |
| ***C10M 169/04*** | (2006.01) |

(52) U.S. Cl.

CPC ..... *C10M 169/04* (2013.01); *C10M 125/22* (2013.01); *C10M 2201/05* (2013.01); *C10M 2201/065* (2013.01); *C10M 2201/066* (2013.01); *C10M 2205/0285* (2013.01); *C10M 2207/0406* (2013.01); *C10M 2207/106* (2013.01); *C10M 2207/2805* (2013.01); *C10M 2215/1026* (2013.01); *C10N 2220/082* (2013.01); *C10N 2230/06* (2013.01); *C10N 2230/28* (2013.01); *C10N 2230/76* (2013.01); *C10N 2240/02* (2013.01); *C10N 2250/10* (2013.01)

USPC ..... 508/167; 508/154

(58) Field of Classification Search

CPC ..... C10N 2210/06; C10M 123/04; C10M 125/06

USPC ..... 508/154, 167

See application file for complete search history.

(56) References Cited

U.S. PATENT DOCUMENTS

| | | | | |
|---|---|---|---|---|
| 2,715,617 | A * | 8/1955 | White | 75/231 |
| 6,432,888 | B1 | 8/2002 | Komiya et al. | |
| 7,404,853 | B2 * | 7/2008 | Kendall | 106/403 |
| 2007/0207934 | A1 * | 9/2007 | Ozaki et al. | 508/168 |
| 2008/0196995 | A1 | 8/2008 | Mikami et al. | |

FOREIGN PATENT DOCUMENTS

| | | | |
|---|---|---|---|
| JP | 3512183 | B2 | 1/2004 |
| JP | 2007-046753 | A | 2/2007 |

(Continued)

OTHER PUBLICATIONS

Extended European Search Report mailed Feb. 26, 2013 in counterpart application No. 12193940.9.

*Primary Examiner* — Pamela H Weiss

(74) *Attorney, Agent, or Firm* — Kratz, Quintos & Hanson, LLP

(57) ABSTRACT

The present invention provides a grease composition which has excellent conductivity and can rapidly remove static electricity generated by using a bearing. The grease composition comprises a base oil, a thickener and a tungsten disulfide powder, wherein the average particle diameter of the tungsten disulfide powder is 0.5 to 5.0 μm and the amount of tungsten disulfide powder based on 100 parts by mass of the total amount of base oil and thickener is 2.0 to 4.0 parts by mass.

2 Claims, 1 Drawing Sheet

(56) References Cited

FOREIGN PATENT DOCUMENTS

| | | | | |
|---|---|---|---|---|
| JP | 4102627 | B2 | | 3/2008 |
| JP | 2008-266424 | A | | 11/2008 |
| JP | 2008266424 | A | * | 11/2008 |
| WO | 2007/085643 | | | 8/2007 |

* cited by examiner

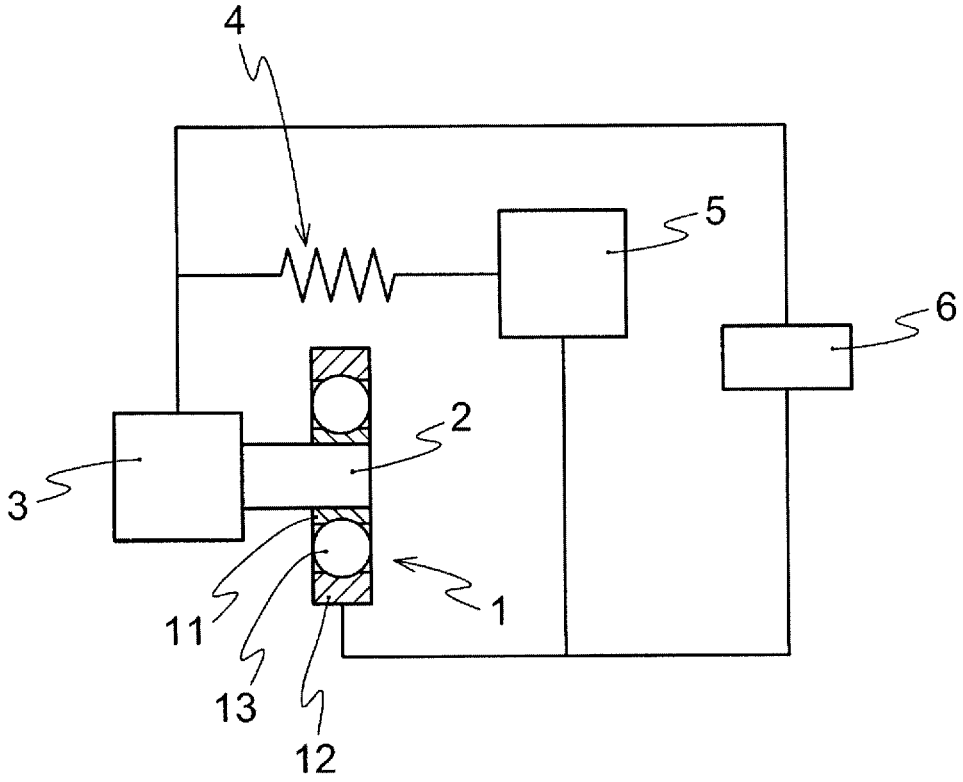
4
5
6
2
3
11
1
13
12

GREASE COMPOSITION AND BEARING

INCORPORATION BY REFERENCE

The disclosure of Japanese Patent Application No. 2011-258234 filed on Nov. 25, 2011 including the specification, drawings and abstract, is incorporated herein by reference in its entirety.

TECHNICAL FIELD

The present invention relates to a grease composition comprising a specific tungsten disulfide powder and a bearing in which the grease composition is filled.

BACKGROUND OF THE INVENTION

Bearings for electrical parts of automobiles such as an alternator, an electromagnetic clutch for a car air conditioner, an intermediate pulley and an electric fan motor, auxiliaries of engine and the like are used under severe environments such as high temperature, high speed, high load and vibration environment. In the bearings used in such severe environments, there is a problem recognized that spalling of the fixed ring surface of the bearing is caused in a period of time being as extremely short as 1/10 or less of a calculated service life theoretically estimated.

A major cause of such spalling is a structural change of steel due to hydrogen or the like which is considered to be generated by deterioration of grease used under severe environments or water in the grease and directly acts on the rolling contact surface (steel surface) between the rolling element and the fixed ring surface of the bearing. In addition, it is known that the hydrogen is generated by a decomposition of the grease or water in the grease due to static electricity caused by using the bearing.

In this connection, a grease for solving such a problem as mentioned above has been reported. For example, JP 3512183 B and JP 4102627 B disclose that antiwear property of the grease can be improved by using the grease comprising a predetermined extreme pressure additive, while improving conductivity of the grease is not considered.

Also, while JP 2007-046753 A and JP 2008-266424 A disclose a grease comprising a predetermined metal powder, it is not disclosed that conductivity of the grease is improved by defining the average particle diameter of the metal powder in a predetermined range.

SUMMARY OF THE INVENTION

An object of the present invention is to provide a grease composition which has excellent conductivity by comprising a tungsten disulfide powder with a predetermined average particle diameter and in turn can rapidly remove static electricity caused by using the bearing.

The grease composition of the present invention is a grease composition comprising a base oil, a thickener and a tungsten disulfide powder. The average particle diameter of the tungsten disulfide powder is 0.5 to 5.0 μm and the amount of tungsten disulfide powder based on 100 parts by mass of the total amount of base oil and thickener is 2.0 to 4.0 parts by mass.

It is further preferable to comprise a tungsten powder, wherein an average particle diameter of the tungsten powder is 0.5 to 2.0 μm, and an amount of tungsten powder is 0.1 to 0.5 part by mass based on 100 parts by mass of the total amount of base oil and thickener.

Further, a bearing of the present invention is characterized by containing the above grease composition.

Effect of the Invention

According to the present invention, a grease composition which has excellent conductivity as well as sustaining antiwear property, extreme pressure property and noise property can be provided. Further, by using a bearing containing this grease composition, static electricity generated by using the bearing can be rapidly removed and thereby a long-life bearing in which a spalling of the rolling contact surface is suppressed can be provided.

BRIEF EXPLANATION OF THE DRAWINGS

FIG. 1 is a diagrammatic view of a conductivity measuring device system used in Examples.

DETAILED DESCRIPTION

The grease composition of the present invention is a grease composition comprising a base oil, a thickener and a tungsten disulfide powder, wherein an average particle diameter of the tungsten disulfide powder is 0.5 to 5.0 μm, and an amount of tungsten disulfide powder is 2.0 to 4.0 parts by mass based on 100 parts by mass of the total amount of base oil and thickener.

The base oil is not limited particularly as far as it is a base oil to be usually used for a grease composition, and it is possible to use one or two or more of, for example, mineral oils refined from crude oil by optional combination of treatments such as distillation under reduced pressure, solvent deasphalting, solvent extraction, hydrogenolysis, solvent dewaxing, washing with sulfuric acid, clay refining and hydrorefining; synthetic diester oils, for example, dibutyl sebacate, di-2-ethylhexyl sebacate, dioctyl adipate, diisodecyl adipate, ditridecyl adipate, ditridecyl glutarate, methylacetyl ricinoleate, and the like; synthetic aromatic ester oils, for example, trioctyl trimellitate, tridecyl trimellitate, tetraoctyl pyromellitate, and the like; synthetic polyol ester oils, for example, trimethylolpropane caprylate, trimethylolpropane pelargonate, pentaerythritol-2-ethylhexanoate, pentaerythritol pelargonate, and the like; synthetic ester oils, for example, complex ester oils which are oligo esters of polyhydric alcohol and a fatty acid mixture of dibasic acid and monobasic acid; synthetic polyglycol oils, for example, polyethylene glycol, polypropylene glycol, polyethylene glycol monoether, polypropylene glycol monoether, and the like; synthetic phenyl ether oils, for example, monoalkyltriphenyl ether, alkyl diphenyl ether, dialkyl diphenyl ether, pentaphenyl ether, tetraphenyl ether, monoalkyl tetraphenyl ether, dialkyl tetraphenyl ether, and the like; synthetic hydrocarbon oils, for example, poly-α-olefins such as a co-oligomer of normal paraffin, isoparaffin, polybutene, polyisobutylene, 1-deceneoligomer or 1-decene withethylene, or hydrides thereof; synthetic silicone oils, for example, dimethyl polysiloxane, diphenyl polysiloxane, alkyl-modified polysiloxane, and the like; and further, synthetic fluorine-containing oils, for example, perfluoro polyether. In particular, alkyl diphenyl ether oil is more preferred from the viewpoint of satisfactory heat resistance and peeling resistance.

Examples of the thickener include a urea compound, a lithium soap, a calcium soap, a sodium soap, an aluminum soap, a sodium terephthalamate, a fluorine, an organic bentonite and a silca gel. Diurea compounds are preferable in terms of their excellent long service life under high temperature and high speed conditions and excellent water resistance.

Diurea compounds are not limited particularly, and it is possible to use a diurea compound represented by the following general formula (I):

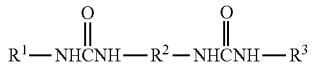

wherein $R^2$ is an aromatic hydrocarbon group having 6 to 15 carbon atoms; and $R^1$ and $R^3$ are respectively an aromatic hydrocarbon group having 6 to 18 carbon atoms, a cyclohexyl group, a cyclohexyl derivative group having 7 to 12 carbon atoms, or an alkyl group having 8 to 22 carbon atoms.

Lithium soaps are not limited particularly either, and it is possible to use a lithium soap synthesized by a lithium hydroxide and a higher fatty acid having 10 to 28 carbon atoms and/or a higher hydroxy fatty acid having one or more hydroxyl group and 10 or more carbon atoms.

The amount of above-mentioned thickener is preferably 9% by mass or more and 30% by mass or less based on 100% by mass of the total amount of base oil and thickener. When the amount of thickener is less than the lower limit, the grease tends to be scattered or leaked due to its softness, and when the amount of thickener is larger than the upper limit, the grease becomes hard, and there is a tendency that a torque of the grease-applied parts increases and a service life is decreased because of seizure by lowering of flowability. A particularly preferred amount is 10% by mass or more, further 15% by mass or more, from the point that a proper flowability can be obtained, and 28% by mass or less, further 25% by mass or less, from the point that a proper flowability can be obtained.

The grease composition of the present invention comprises a tungsten disulfide powder with a predetermined average particle diameter since excellent conductivity can be obtained.

The average particle diameter of the tungsten disulfide powder is 0.5 μm or more, preferably 1.0 μm or more and more preferably 1.5 μm or more. When the average particle diameter of the tungsten disulfide powder is less than 0.5 μm, a worker may easily inhale it and thus the handling thereof becomes difficult. On the other hand, the average particle diameter of the tungsten disulfide powder is 5.0 μm or less, preferably 3.0 μm or less and more preferably 2.0 μm or less. When the average particle diameter of the tungsten disulfide powder is more than 5.0 μm, the effect of improving conductivity is lowered and noise property is deteriorated. Additionally, it should be noted that the average particle diameter of the tungsten disulfide powder in the present invention is measured using laser diffraction technique.

The amount of tungsten disulfide powder based on 100 parts by mass of the total amount of base oil and thickener is 2.0 parts by mass or more, preferably 2.2 parts by mass or more and more preferably 2.4 parts by mass or more. When the amount of tungsten disulfide powder is less than 2.0 parts by mass, the effect of improving conductivity is lowered. On the other hand, the amount of tungsten disulfide powder is 4.0 parts by mass or less, preferably 3.8 parts by mass or less and more preferably 3.5 parts by mass or less. When the amount of tungsten disulfide powder is more than 4.0 parts by mass, the grease becomes hard and flowability is lowered, thereby deteriorating lubricity and noise property.

It is preferable that the grease composition of the present invention comprises a tungsten powder with a predetermined average particle diameter. By comprising the tungsten powder, there is a tendency that conductivity of the grease composition is improved and stability thereof is also improved.

It is preferable that the average particle diameter of the tungsten powder is 0.5 μm or more. When the average particle diameter of the tungsten powder is less than 0.5 μm, a worker may easily inhale it and thus the handling thereof becomes difficult. On the other hand, the average particle diameter of the tungsten powder is preferably 2.0 μm or less, more preferably 1.5 μm or less and further preferably 1.0 μm or less. When the average particle diameter of the tungsten powder is more than 2.0 μm, there is a tendency that the effect of improving conductivity is lowered and noise property is deteriorated. Additionally, it should be noted that the average particle diameter of the tungsten powder in the present invention is measured using laser diffraction technique.

In the case where the tungsten powder is comprised, the amount thereof based on 100 parts by mass of the total amount of base oil and thickener is preferably 0.1 part by mass or more and more preferably 0.15 part by mass or more. When the amount of tungsten powder is less than 0.1 part by mass, the effect of improving conductivity tends to be lowered. On the other hand, the amount of tungsten powder is preferably 0.5 part by mass or less, more preferably 0.3 part by mass or less and further preferably 0.2 part by mass or less. When the amount of tungsten powder is more than 0.5 part by mass, lubricity tends to be deteriorated.

In addition, various additives such as an antioxidant, an extreme pressure additive, an antiwear additive, a dye, a color stabilizer, a viscosity improver, a structure stabilizer, a metal deactivator, a viscosity index improver and a rust-preventing additive may be added to the grease composition in proper amounts to such an extent not to impair the effect of the present invention. When these additives are contained in the grease composition, the amount thereof in the grease composition can be 10 parts by mass or less based on 100 parts by mass of the total amount of base oil and thickener.

The bearing of the present invention contains the above-mentioned grease and has a long service life even under severe environments, and therefore, is preferably used as bearings for electrical parts of automobiles such as an alternator, an electromagnetic clutch for a car air conditioner, an intermediate pulley and an electric fan motor, auxiliaries of engine and the like, which are used under severe environments such as high temperature, high speed and high load and vibration environment. The amount of grease composition to be filled in applied parts thereof can be optionally changed depending on type and dimensions of the applied parts, and may be the same as usual.

The present invention is explained below in detail by means of Examples, but is not limited to these Examples.

Evaluating methods are as follows.

<Conductivity Measuring Test>

A test bearing containing sample grease was rotated and a potential difference between the inner race and the outer race of the test bearing during rotation was measured. FIG. 1 is a diagrammatic view of the used conductivity measuring device system. A rotating shaft 2 rotated by power of a driving motor (not shown) was fixed to the inner surface of the inner race 11 of the test bearing 1 and the rotating shaft 2 was rotated under the following operation conditions, with the outer race 12 being used as the fixed ring. A slip ring 3 was provided on the rotating shaft 2. In addition, a predetermined voltage was applied with a power source 5 via a resistance 4 and a potential difference between the inner race 11 and the outer race 12 was measured with a detector 6.

The smaller the potential difference detected by this testing method is, the more excellent the conductivity of the filled sample grease is. On the other hand, the larger the measurement result is, the more deteriorated conductivity the sample grease has, and when the potential difference is the same as the voltage (2.0 V) applied by the power source 5, it shows that the grease is an insulator. Additionally, the potential difference of 1.6 V or less is a performance target value.

Test conditions are as follows:

Test bearing: single row deep groove ball bearing (608, with the use of a resin retainer)

Amount of the filled grease: 0.1 g

Interval between sampling: 1 second

Operation Conditions

- Number of revolutions: 250 rpm
- Radial load: 3.5 N
- Thrust load: 1.3 N
- Temperature of the outer race of the bearing: room temperature (25° C.)
- Operation time: 10 minutes after 10 minutes of running-in period Charge Conditions

- Voltage: 2.0 V
- Resistance: 300 kΩ

<Extreme Pressure Test>

The weld load of the sample grease was measured with the method of ASTM D 2596 (high-speed four ball test). The larger the value of weld load (N) is, the more excellent the extreme pressure property is.

Test conditions are as follows:

Number of revolutions: 1770 rpm

Test temperature: room temperature (25° C.)

Test time: 10 seconds

<Antiwear Test>

The friction coefficient of the sample grease was measured in accordance with the method of ASTM D 5706 (SRV test). The smaller the friction coefficient (μ) is, the more excellent the antiwear property is.

Test conditions are as follows:

Frequency: 50 Hz

Stroke: 1 mm

Test temperature: room temperature (25° C.)

Test load: 200 N

Test time: 30 minutes

<Noise Test>

The sample grease of 0.8 g was filled into a sealed deep groove ball bearing (model number: 62022RU), the thrust load of 20 N was applied, followed by rotation at 1800 $min^{-1}$ for 30 seconds to evaluate an anderon value by use of an anderon meter (model number: ADA-15, manufactured by Sugawara Laboratories Inc.). In the evaluation results, the value of 5 anderon or less was deemed as good and the value more than 5 was deemed as not good.

EXAMPLE

In Examples of the present invention, the following materials were used.

Base Grease

Urea grease (1): A diurea compound of 16 parts by mass was added into 84 parts by mass of an alkyl diphenyl ether oil to prepare a urea grease (1) of Grade 2 to 3 Penetration [penetration grade of the NLGI (US grease institute) classification].

Urea grease (2): A diurea compound of 16 parts by mass was added into 84 parts by mass of a poly-α-olefin oil to prepare a urea grease (2) of Grade 2 to 3 Penetration.

Lithium grease: A lithium soap of 10 parts by mass was added into 90 parts by mass of an ester oil to prepare a lithium grease of Grade 2 to 3 Penetration.

Additives

Tungsten disulfide powder (1): Tribotecc (registered trademark) WS2 (average particle diameter: 2.0 μm) manufactured by Chemetall GmbH Tungsten disulfide powder (2): Tribotecc (registered trademark) WS5 (average particle diameter: 10.0 μm) manufactured by Chemetall GmbH Molybdenum disulfide powder: C Powder (average particle diameter: 1.2 μm) manufactured by Nichimoly Division, Daizo Corporation Tungsten powder (1): W Powder (average particle diameter: 0.6 μm) manufactured by Kojundo Chemical Laboratory Co., Ltd.

Tungsten powder (2): W Powder (average particle diameter: 1.0 μm) manufactured by Kojundo Chemical Laboratory Co., Ltd.

Tungsten powder (3): W Powder (average particle diameter: 53 μm) manufactured by Kojundo Chemical Laboratory Co., Ltd.

Tungsten powder (4): W Powder (average particle diameter: 150 μm) manufactured by Kojundo Chemical Laboratory Co., Ltd.

Examples 1 to 8 and Comparative Examples 1 to 9

According to the compounded amount shown in Tables 1 and 2, the additives were added into the base grease to obtain a sample grease. The above evaluations were made with reference to the obtained sample grease. The results are shown in Tables 1 and 2. Here, the mark "–" in the evaluation results of Comparative Examples shows that the evaluation test was not conducted.

TABLE 1

| | Examples | | | | | | | |
|---|---|---|---|---|---|---|---|---|
| | 1 | 2 | 3 | 4 | 5 | 6 | 7 | 8 |
| Base grease | | | | | | | | |
| Urea grease (1) | 100.0 | 100.0 | 100.0 | 100.0 | 100.0 | — | — | — |
| Urea grease (2) | — | — | — | — | — | — | — | 100.0 |
| Lithium grease | — | — | — | — | — | 100.0 | 100.0 | — |
| Additive | | | | | | | | |
| Tungsten disulfide powder (1) | 2.5 | 3.5 | 2.5 | 2.5 | 3.5 | 2.5 | 3.5 | 2.5 |
| Tungsten disulfide powder (2) | — | — | — | — | — | — | — | — |
| Molybdenum disulfide powder | — | — | — | — | — | — | — | — |
| Tungsten powder (1) | — | — | 0.2 | — | — | — | — | — |

TABLE 1-continued

| | Examples | | | | | | | |
|---|---|---|---|---|---|---|---|---|
| | 1 | 2 | 3 | 4 | 5 | 6 | 7 | 8 |
| Tungsten powder (2) | — | — | — | 0.2 | 0.3 | — | — | — |
| Tungsten powder (3) | — | — | — | — | — | — | — | — |
| Tungsten powder (4) | — | — | — | — | — | — | — | — |
| Evaluation result | | | | | | | | |
| Potential difference (V) | 1.6 | 1.4 | 0.8 | 1.3 | 1.0 | 1.6 | 1.5 | 1.6 |
| Weld load (N) | 1961 | 2452 | 1961 | 1961 | 2452 | 1961 | 2452 | 1961 |
| Friction coefficient (μ) | 0.13 | 0.12 | 0.14 | 0.14 | 0.12 | 0.11 | 0.11 | 0.12 |
| Noise property | good | good | good | good | good | good | good | good |

TABLE 2

| | Comparative Examples | | | | | | | | |
|---|---|---|---|---|---|---|---|---|---|
| | 1 | 2 | 3 | 4 | 5 | 6 | 7 | 8 | 9 |
| Base grease | | | | | | | | | |
| Urea grease (1) | 100.0 | 100.0 | 100.0 | 100.0 | 100.0 | 100.0 | 100.0 | 100.0 | 100.0 |
| Urea grease (2) | — | — | — | — | — | — | — | — | — |
| Lithium grease | — | — | — | — | — | — | — | — | — |
| Additive | | | | | | | | | |
| Tungsten disulfide powder (1) | — | — | 1.3 | 5.1 | 1.3 | — | — | — | — |
| Tungsten disulfide powder (2) | — | 2.5 | — | — | — | — | — | — | — |
| Molybdenum disulfide powder | — | — | — | — | — | — | — | — | 2.5 |
| Tungsten powder (1) | — | — | — | — | — | — | — | — | — |
| Tungsten powder (2) | — | — | — | — | 0.1 | 0.2 | — | — | — |
| Tungsten powder (3) | — | — | — | — | — | — | 0.2 | — | — |
| Tungsten powder (4) | — | — | — | — | — | — | — | 0.2 | — |
| Evaluation result | | | | | | | | | |
| Potential difference (V) | 2.0 | 1.8 | 2.0 | 0.7 | 1.8 | 1.5 | 2.0 | 2.0 | 1.9 |
| Weld load (N) | 1569 | — | — | — | — | 1569 | — | — | — |
| Friction coefficient (μ) | seizure after 120 seconds | — | — | — | — | — | — | — | — |
| Noise property | good | not good | — | not good | — | — | — | — | — |

EXPLANATIONS OF SYMBOLS

1 Test bearing
11 Inner race
12 Outer race
13 Rolling element (ball)
2 Rotating shaft
3 Slip ring
4 Resistance
5 Power source
6 Detector

What is claimed is:

1. A grease composition, comprising:

a base oil;

a thickener;

a tungsten disulfide powder; and a tungsten powder, wherein an average particle diameter of the tungsten disulfide powder is 1.5 to 2.0 μm, wherein an amount of the tungsten disulfide powder is 2.4 to 3.5 parts by mass based on 100 parts by mass of the total amount of the base oil and the thickener, wherein an average particle diameter of the tungsten powder is 0.5 to 1.5 μm, and wherein an amount of the tungsten powder is 0.15 to 0.3 part by mass based on 100 parts by mass of the total amount of the base oil and the thickener, wherein the base oil is an alkyl diphenyl ether oil, a poly-α-olefin oil or an ester oil, and wherein the thickener is a diurea compound or a lithium soap.

2. A bearing containing the grease composition of claim 1.

* * * * *